United States Patent [19]

Asano et al.

[11] 4,107,640

[45] Aug. 15, 1978

[54] CURRENT LIMITING ELEMENT FOR PREVENTING ELECTRICAL OVERCURRENT

[75] Inventors: Chihiro Asano, Kakamigahara; Shigeyuki Hikita; Kunio Kato, both of Nagoya, all of Japan

[73] Assignee: Kabushiki Kaisha Tokai Rika Denki Seisakusho

[21] Appl. No.: 743,322

[22] Filed: Nov. 19, 1976

[30] Foreign Application Priority Data

Nov. 19, 1975 [JP] Japan ..... 50-139007

[51] Int. Cl.[2] ..... H01C 7/13; H01C 7/02

[52] U.S. Cl. ..... 338/23; 338/22

[58] Field of Search ..... 338/20–25, 338/223–225; 219/528, 552, 553, 505, 504; 29/612, 613; 252/511–514

[56] References Cited

U.S. PATENT DOCUMENTS

| | | | |
|---|---|---|---|
| 2,332,596 | 10/1942 | Pearson | 338/23 |
| 3,138,686 | 6/1964 | Mitoff et al. | 338/20 X |
| 3,238,355 | 3/1966 | VanEeck | 219/528 |
| 3,634,840 | 1/1972 | Wilkinson | 338/25 X |

*Primary Examiner*—C. L. Albritton

*Attorney, Agent, or Firm*—Koda and Androlia

[57] ABSTRACT

A current limiting element for preventing electrical overcurrent including a principal current conducting member made of a low resistance conductive elastomer having a high coefficient of thermal expansion and having a flattened cross-sectional shape and a heating/heat insulating member which consists of a high resistance conductive elastomer or a resistive coating surrounding the circumference of the conducting member.

7 Claims, 9 Drawing Figures

(a)

(b)

(a)

(b)

CURRENT LIMITING ELEMENT FOR PREVENTING ELECTRICAL OVERCURRENT

BACKGROUND OF THE INVENTION

1. Field of Invention

This invention relates to current limiting elements for preventing electrical overcurrent and more particularly to current limiting elements which are reuseable.

2. Prior Art

In Japanese Patent Application No. S50-87595 is described a current limiting element for preventing electrical overcurrent including a principal current conducting member made of a low resistance conductive elastomer having a high coefficient of thermal expansion and having a circular cross-sectional shape and a heating/heat insulating member which consists of a high resistance conductive elastomer or resistive coating surrounding the circumference of the conducting member. Since the cross-sectional shape of this current limiting element was completely circular, as shown in FIGS. 1(a) and 1(b), the effect of ambient temperature upon the length of time required for current limiting action to occur was great when the amount of current was relatively large, in the vicinity of 20–30 amperes. Specifically, when overcurrent flowed through the principal current conducting part A, the time required for current limiting action to occur was extremely long in a low temperature environment. Even though the conducting part A was heated to some extent by the instantaneous heat generation arising from the Joule effect, the length of time required for heat transmission increased as the circumference of the current limiting element was approached. Furthermore, since the external air temperature was low, the amount of heat radiation was also great. Therefore, the temperature necessary for interrupting the flow of overcurrent was sometimes not reached, and as a result, the internal temperature became non-uniform so that the length of time required for current limiting action to occur was increased. Furthermore, when the amount of heat radiation was greater than the amount of spontaneous heat generation as a result of overcurrent, the overcurrent was never interrupted.

In addition, another drawback was that in high temperature environments, the length of time required for current limiting action to occur was greatly decreased by a phenomenon just the reverse of that discussed above.

SUMMARY OF THE INVENTION

It is the general object of the present invention to provide a current limiting device for interrupting the flow of overcurrent which is substantially unaffected by the temperature of its environment.

It is still another object of the present invention to provide a current limiting element which is simple to manufacture and of moderate price.

In keeping with the principles of the present invention, the objects are accomplished by a unique current limiting element for preventing electrical overcurrent which consists of a principal current conducting member made of a low resistance conductive elastomer having a high coefficient of thermal expansion and having a flattened cross-section and a heat/heat insulating member which consists of a high resistance conductive elastomer or a resistive coating surrounding the circumference of the conducting member.

In a second embodiment, an indirect heating element is added external to the heat/heat insulating member in order to improve temperature dependability.

BRIEF DESCRIPTION OF THE DRAWINGS

The above mentioned and other features and objects of the present invention will become more apparent by reference to the following description taken in conjunction with the accompanying drawings, wherein like reference numerals denote like elements and in which.

DETAILED DESCRIPTION OF THE INVENTION

Figure 1:
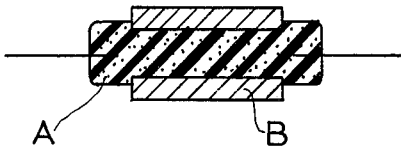
FIG. 1(a) is a side cross-sectional view of a prior art current limiting element.
FIG. 1(b) is an oblique view of a prior art current limiting element.
Figure 1:
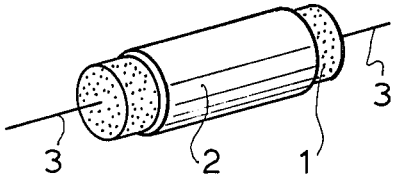
Figure 2:
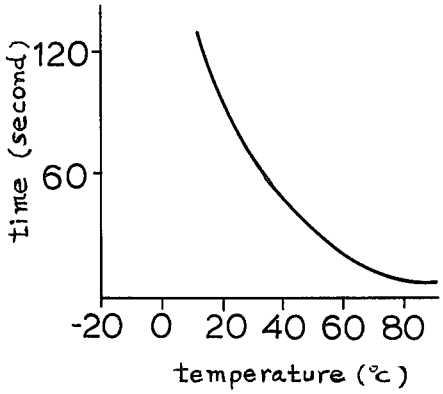
FIG. 2 is a characteristics diagram of a prior art current limiting element.
Figure 3:
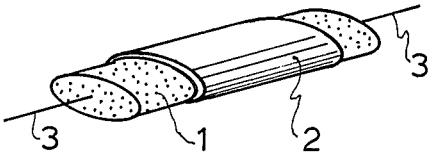
FIG. 3 is an oblique view of a current limiting element in accordance with the teachings of the present invention.

Referring more particularly to the drawings, shown in FIG. 3 is a current limiting element in accordance with the teachings of the present invention. The current limiting element of FIG. 3 includes a principal current conducting member 1 having a flattened cross-section. The principal current conducting member 1 is manufactured by mixing conductive metallic particles of a substance such as gold, silver, platinum, etc., which is either unaffected by oxidation or corrosion or in which the compounds formed by oxidation and corrosion are electrically conductive with an elastic insulating material such as silicone rubber, etc., which has a high positive coefficient of thermal expansion, is heat resistant and whose material properties are stable at high and low temperatures. Heat resistance heating/heat insulating member 2 covers and is provided on the circumference of the principal current conducting member 1. The heating/heat insulating member 2 consists of either a high resistance conductive elastomer formed by mixing a high resistance powdered metal, such as nickel chromium alloy or powdered carbon black, etc., with an insulating material or a resistive coating, whose chief ingredient is carbon black, which is deposited directly upon the circumferential surface of the principal current conducting member 1. Furthermore, the heating/heat insulating member 2 is for the additional purpose of sealing into the principal current conducting member 1 the Joule heat generated when overcurrent flows through the conducting member 1. Furthermore, the heating/heat insulating member 2 is also for the purpose of imparting just enough heat to the principal current conducting member 1 to insure that the interruption of current is maintained after the circuit is broken. This is accomplished by means of Joule heat which is generated by a small amount of current flowing through the heating/heat insulating member 2 after the principal current has been interrupted by the conducting member 1. Accordingly, the heating/heat insulating member 2 must have a high resistance value and a low coefficient of overall heat transmission and also a high stability at high temperatures. Also, principal current conducting part 1 is provided with terminals 33 for electrical connection.

In operation, when an overcurrent above 20–30 amperes flows through the principal current conducting member 1, the elastic insulating material of the conducting member 1 generates Joule heat from the overcurrent and undergoes thermal expansion. Accordingly, since the density of the individual conductive particles mixed with the elastic material is decreased, the contact resistance between the particles is increased. As a result, the Joule heat generated by the overcurrent increases even further and the thermal expansion of the principal current conducting part 1 is further accelerated. Since the principal current conducting member 1 expands rapidly as the above phenomenon continues, mutual contact between the metallic particles is broken and the conductive circuit is eventually interrupted. In this case, the interruption of current occurs along a plane perpendicular to the direction of current flow in the principal current conducting member 1.

After the principal current has been interrupted, a small amount of current flows through the heating/heat insulating member 2. In this way, the vicinity of the plane of interruption is heated and heat insulated by the Joule heat generated by the small amount of current flowing through the heating/heat insulating member 2 so that the interruption of the principal current is maintained. This condition continues until the current supply is cut and the source of overcurrent is eliminated. When the power source is subsequently cut off and the source of overcurrent eliminated, the principal current conducting member 1 will gradually cool off and return to its normal condition and the conducting circuit is once again complete.

In this embodiment, since the average heat transmission distance is shorter than in the prior art cylindrical model due to the fact that the cross-sectional shape of the current limiting element itself is flattened, the time required for the transmission of heat generated by the heating/heat insulating member 2 to the central portion of the current limiting element is reduced. Furthermore, the time required for the transmission of heat arising from the spontaneous heat generation of the principal current conducting member 1 to the peripheral portion of the element is also shortened. Accordingly, uniform heating is obtained and the current interrupting characteristics are greatly improved.

Figure 4:
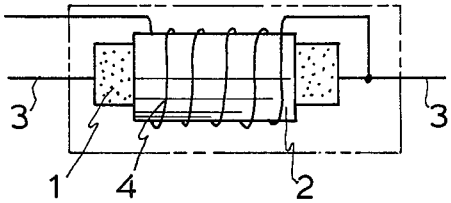
FIG. 4(a) is a side plan view of a second embodiment of a current limiting element in accordance with the teachings of the present invention.
FIG. 4(b) is a side plan view of a third embodiment of a current limiting element in accordance with the teachings of the present invention.

Referring to FIG. 4(a), shown therein is a second embodiment of a current limiting element in accordance with the teachings of the present invention. In this embodiment, an attempt is made to improve the current interrupting characteristics and particularly to improve the ability to respond in a low temperature environment. Since the embodiment of FIG. 4 is similar to that shown in FIG. 3, like elements are given like reference numerals and a discussion of their interconnection and operation will be omitted.

As shown in the embodiment of FIG. 4(a), an indirect heating member 4, consisting of a heat generating body, is installed around the circumference of the heating-/heat insulating part 2 and is electrically connected in parallel with the current limiting element.

This indirect heating member 4 is provided so that when overcurrent above a given value flows through the principal current conducting member 1 in a low temperature environment, the current limiting element is heated by the spontaneous heat generation arising from the Joule effect. However, since the external temperatures are low, the amount of heat radiation is high and the temperature necessary for interrupting the flow of current is not reached. Accordingly, the installation of the indirect heating part 4 around the outside of current limiting element for heating purposes decreases the temperature gradient inside the current limiting element so that the principal current conducting member 1 is maintained at an appropriate temperature thereby insuring that current limiting action will be obtained in the low temperature environment. Furthermore, although the indirect heating member 4 in this embodiment is installed around the circumference of the heating/heat insulating member 2, it would also be appropriate to install it inside the principal current conducting member 1.

Figure 5:
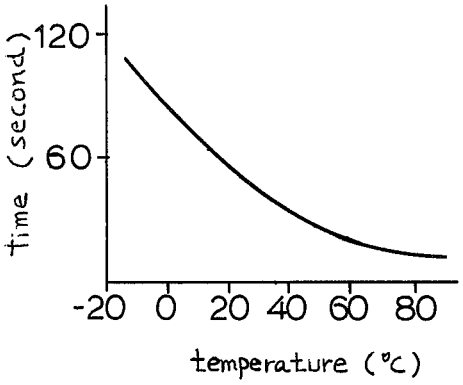
FIG. 5 is a characteristics diagram of a current limiting element in accordance with the teachings of the present invention.
Figure 4:
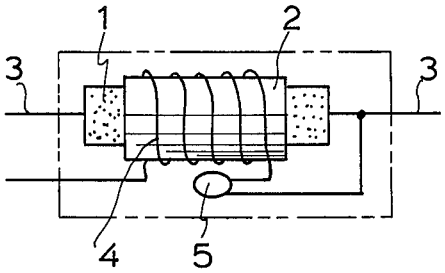

Furthermore, since in a low temperature environment the effect of the heat capacity of the current limiting element is greater than the heating effect of the indirect heating member 4, the time required for the current limiting action to occur is very nearly uniform, see FIG. 5.

Referring to FIG. 4(b), shown therein is a third embodiment of a current limiting element in accordance with the teachings of the present invention. Since the embodiment of FIG. 4(b) is substantially similar to the embodiment of FIG. 4(a), like elements are given like reference numerals and a description of their interconnection and operation will be omitted.

In the embodiment of FIG. 4(b), the temperature of the indirect heating member 4 may be controlled by connecting a heat detecting element 5 with precise characteristics, such as a ceramic thermistor, in series with the indirect heating member 4.

Figure 6:
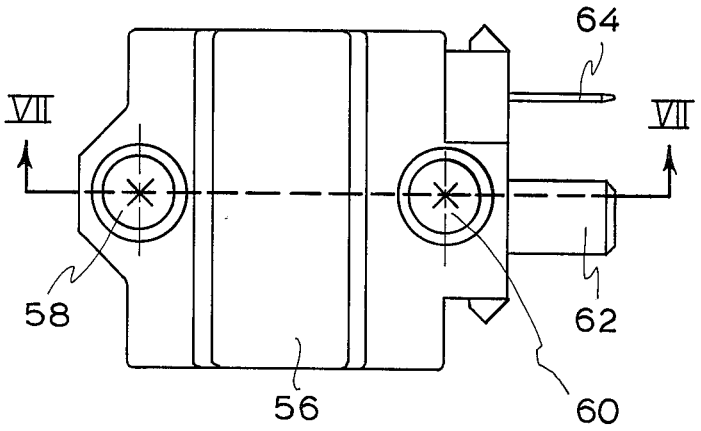
FIG. 6 is a plan view of a fourth embodiment of a current limiting element in accordance with the teachings of the present invention.
Figure 7:
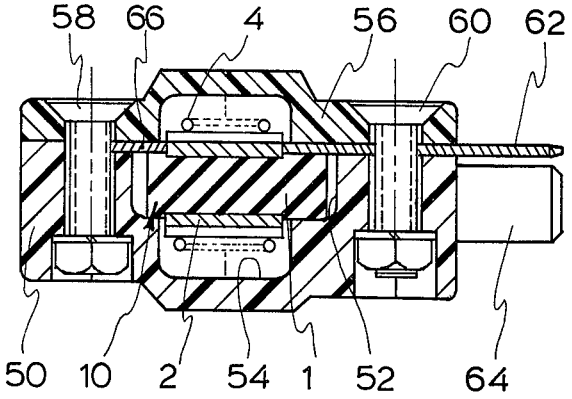
FIG. 7 is a cross-sectional view of the embodiment of FIG. 6 along the lines VII-VII.

Referring to FIGS. 6 and 7, shown therein is an appropriate embodiment in which a current limiting element in accordance with the teachings of the present invention is installed within a case. The current limiting element 10 includes a principal current conducting member 1 and a heating/heat insulating part 2. The indirect heating part 4 is installed around the circumference of the heating/heat insulating member 2.

The current limiting element 10 is inserted into an opening 52 provided in the interior of the case 50 which is made of an insulating material. A recess 54 which connects with the opening 52 is provided in the case 50 so that the heating/heat insulating member 2 and the indirect heating member 4 are prevented from coming into contact with the case 50.

The case cover 56 is fastened to the case 50 by screws 58 and 60. When the case cover 56 is fastened to the case 50, the terminal plates 62, 64 and 66 are at the same time inserted between the case and the case cover. One end of terminal plate 62 is pressed against one end of the current limiting element 10 so that electrical continuity is insured. One end of terminal plate 66 is pressed against the other end of current limiting element 10 and the other end of terminal plate 66 is soldered to one end of indirect heating member 4. The other end of indirect heating member 4 is soldered to terminal plate 64. Accordingly, when the terminal plates 62 and 64 are connected with a principal current circuit of an electrical circuit, the principal current flows from the terminal plate 62 through element 10, terminal plate 66 and indirect heating member 4 to terminal plate 64 and overcurrent is prevented from flowing to the load.

As described above, in this invention the ability to respond to overcurrent has been improved by flattening the cross-sectional shape of the principal current conducting member 1 and the current limiting characteristics at various ambient temperatures, and especially at low ambient temperatures, have been improved by the installation of an indirect heating element 4 either inside or outside the current limiting element. It should be apparent that by means of a current limiting element in accordance with the teachings of the present invention, it is possible to provide at a moderate price a stable current limiting element for preventing electrical overcurrent which possesses a long useful life.

In all cases it should be apparent to one skilled in the art that the above described embodiments are merely illustrative of but a few of the many possible specific embodiments which represent the applications of the principles of the present invention. Numerous and other varied other arrangements can be readily devised by those skilled in the art without departing from the spirit and scope of the present invention.

I claim:

1. A current limiting element comprising:

a principal current conducting member made from a low resistance conductive elastomer having a high positive coefficient of thermal expansion, said principal conducting member having a flattened cross-sectional shape;

a heating/heat insulating member having a high resistance surrounding the circumference of said conducting member; and an indirect heating element disposed adjacent said heating/heat insulating member.

2. A current limiting element according to claim 1 wherein said principal current conducting member is made from silicone rubber mixed with conductive particles selected from the group consisting of gold, silver and platinum.

3. A current limiting element comprising:

a principal current conducting member made from a low resistance conductive elastomer having a high positive coefficient of thermal expansion, said principal conducting member having a flattened cross-sectional shape; and a heating/heat insulating member having a high resistance surrounding the circumference of said conducting member, said heating/heat insulating member being made of a high resistance conductive elastomer.

4. A current limiting element according to claim 1 wherein said heating/heat insulating member is a high resistance coating.

5. A current limiting element according to claim 4 wherein said high resistance coating comprising carbon black deposited directly on said principal current conducting member.

6. A current limiting element according to claim 1 further comprising a heat detecting element in series with said indirect heating element and continguous with said indirect heating element.

7. A current limiting element according to claim 6 wherein said heat detecting element is a thermistor.

* * * * *